US006145590A

United States Patent [19]

Havard

[11] Patent Number: 6,145,590

[45] Date of Patent: Nov. 14, 2000

[54] DEVICE FOR REMOVING SAND FROM PUMP PLUNGERS

[76] Inventor: Kenneth Havard, P.O. Box 800103, Houston, Tex. 77280

[21] Appl. No.: 09/232,237

[22] Filed: Jan. 19, 1999

Related U.S. Application Data

[60] Provisional application No. 60/075,185, Feb. 19, 1998.

[51] Int. Cl.[7] ..... E21B 37/10; E21B 43/00

[52] U.S. Cl. ..... 166/105.2; 166/105.1; 166/110; 417/555.2

[58] Field of Search ..... 166/105.1–105.5, 166/107, 110; 417/430, 555.2; 92/78

[56] References Cited

U.S. PATENT DOCUMENTS

| | | | |
|---|---|---|---|
| 1,309,738 | 7/1919 | Latta | 166/105.2 |
| 4,629,402 | 12/1986 | Marshala | 417/456 |
| 4,661,052 | 4/1987 | Ruhle | 417/552 |
| 5,360,062 | 11/1994 | White | 166/105.1 |
| 5,505,260 | 4/1996 | Anderson et al. | 166/278 |

OTHER PUBLICATIONS

Harbison–Fischer Sub–Surface Pumps Brochure 1992–93, Condensed Catalog, pp. 1–8.

*Primary Examiner*—George Suchfield

*Attorney, Agent, or Firm*—Harrison & Egbert

[57] ABSTRACT

A sand removal apparatus for use with an oil pumping apparatus in which a first sand remover is attached between a valve rod and a plunger of the oil pumping apparatus and a second sand remover is attached to a bottom of the plunger within the working barrel of the oil pumping apparatus. The first sand remover has a body with an interior passageway extending longitudinally therethrough. The body has a first threaded end attached to the plunger cage associated with the valve rod of the oil pumping apparatus and a second threaded end attached to the plunger. A circumferential groove extends around the body between the ends. A wiper is positioned within the circumferential groove so as to have an edge extending outwardly of the groove so as to be in wiping contact with the working barrel. The second sand remover has a body with an interior passageway extending longitudinally therethrough and having a first threaded end attached to the bottom of the plunger. The body has a groove formed circumferentially therearound so as to receive a wiping member therein. The wiping member is an annular member having an edge extending outwardly of the circumferential groove so as to be in wiping contact with the working barrel.

20 Claims, 4 Drawing Sheets

DEVICE FOR REMOVING SAND FROM PUMP PLUNGERS

RELATED APPLICATION

The present utility patent application is based upon U.S. Provisional Patent Application Serial No. 60/075,185, filed on Feb. 19, 1998, and entitled "DEVICE FOR REMOVING SAND FROM PUMP PLUNGERS", presently pending.

TECHNICAL FIELD

The present invention relates to sub-surface pumps which are used for the removal of oil from oil wells. More particularly, the present invention relates to devices that can be used with such sub-surface pumps so as to prevent the accumulation of sand and the destructive effects associated therewith.

BACKGROUND ART

FIG. 1 shows at 10 a sub-surface pump of the type commonly used in the prior art. The sub-surface pump 10, which is shown in FIG. 1, is of a type manufactured by Harbison-Fischer, of Crowley, Tex., which is utilized for the pumping of oil from an oil well. The pump 10 includes a valve rod 12 which is connected, at one end, to the sucker rod of the oil well. The valve rod 12 extends into the downhole tubing 14. In particular, the valve rod 12 is received within the working barrel 16 of the pump apparatus 10. The valve rod 12 is connected to the plunger 18 through the plunger cage 20. A one way valve 22 is provided at an end of the plunger 18 opposite the plunger cage 20. Another one way valve 24 is provided at the end of the working barrel 16 below the one way valve 22 of the plunger 18.

In normal operation, the sucker rod associated with the oil well will cause the valve rod 12 to move upwardly and downwardly. As the valve rod 12 moves downwardly, the one way valve 22 will open so as to allow oil and any suspended sand to enter the interior of the plunger 18. When the plunger 18 reaches the bottom of its stroke, the one way valve 22 will close so as to retain the oil and suspended sand within the interior of the plunger 18. The oil and suspended sand will exit the plunger 18 so as to be delivered into the interior of the tubing 14 for transport to the surface. Unfortunately, when oil is released from the plunger 18, the sand will tend to settle in the area around the top of the plunger 18. Eventually, this sand will wear on the plunger and its associated sealing mechanisms. This grinding action caused by the sand will cause the seal to wear down and lose pressure. Ultimately, it could cause the seizure of the pump. The sand will tend to accumulate in the small cavity on the top of the plunger 18 between the working barrel 16 and the plunger cage 20. When the plunger 18 moves upwardly, the one way valve 24 will open so as to allow oil and suspended sand to enter the interior 26 of the working barrel 16.

Referring to FIG. 2, a more detailed view of the pump 10 is illustrated. In particular, it can be seen that the plunger cage 20 is positioned within the working barrel 16 of the pump apparatus. The upper threaded end 17 of the plunger 18 is threadedly received by the interior threads 19 of the plunger cage 20. As can be seen in FIG. 2, sand can accumulate on the top of the plunger 18. On the upstroke of the plunger cage 20, the sand is forced between the plunger 18 and the wall of the working barrel 16.

FIG. 2 also shows the lower part of the plunger 18. As can be seen, the ball valve 22 is threadedly received by the exterior threads 21 at the bottom of the plunger 18. In particular, the upper portion of the ball valve 22 has an internally threaded section 25 which threadedly attaches to the exterior threads 21 of the plunger 18. A seat plug 27 is threadedly affixed to the bottom of the ball valve 22. Seat plug 27 has an interior passageway 29 which allows oil to flow therethrough toward the ball valve 22. As can be seen in FIG. 2, sand is shown as trapped between the traveling valve cage 20 and the working barrel 16. On the downstroke, the sand is forced between the plunger 18 and the working barrel 16.

It is an object of the present invention to provide a device for use on the plunger so as to effectively keep sand from accumulating in sensitive locations around the plunger.

It is another object of the present invention to provide a device which effectively flushes sand from critical areas of the pumping apparatus.

It is still another object of the present invention to provide a sand removal device which extends the life of the pumping mechanism and reduces the deteriorating effects caused by sand accumulation.

It is still a further object of the present invention to provide a device for the removal of sand which is easy to use, easy to install, and relatively inexpensive.

These and other objects and advantages of the present invention will become apparent from a reading of the attached specification and appended claims.

SUMMARY OF THE INVENTION

The present invention comprises a first sand removal device which is attached to the top of plunger between the plunger and the plunger cage. Another sand removal device is connected to an end of the plunger. The first sand removal device includes a body with an interior passageway for allowing the flow of oil therethrough. A first externally threaded area is formed at the top of the body. An internally threaded area is formed at the bottom of the body. The externally threaded area is suitable for attachment to the plunger cage of the pumping mechanism. The bottom threaded area is suitable for attachment to the plunger of the pumping apparatus. A groove is formed circumferentially around the exterior of the body between the top threaded area and the bottom threaded area. A wiper member is received within the groove so as to have an edge extending outwardly of the groove. This edge of the wiper member will be suitable for wiping contact with the internal surfaces of the working barrel of the pump apparatus. The interior passageway has a frustoconical section which extends from and communicates with the bottom threaded area. A straight tubular section will extend from the top of the frustoconical section so as to allow the flow of fluid outwardly of the top of the externally threaded area.

The second sand removal device will be attached to the opening located adjacent to the one way valve at the bottom of the plunger. The second sand removal device includes a body having an externally threaded area located at a top of the body. The externally threaded area is connected to the opening at the one way valve. A groove is formed circumferentially around the body so as to receive an annular wiping member therein. The wiping member has an edge suitable for wiping action against the interior surface of the working barrel of the pumping apparatus. An interior passageway is formed through the body. A venturi cone is formed at the bottom of the device so as to extend inwardly of the device. A radial passageway opens to the venturi passageway. This radial passageway is formed below the wiping member on a side opposite to the upper threaded area.

In each of the first and second wiping devices, pressure equalization ports are formed through the respective bodies so as to avoid any pressure buildups or to avoid any requirements for pressure resistance by the sealing members associated with each of the bodies.

DETAILED DESCRIPTION OF THE PRESENT INVENTION

Figure 1:
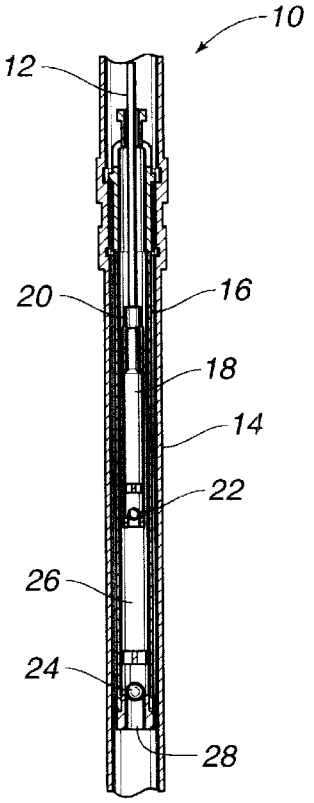
FIG. 1 Prior Art
FIG. 1 is a cross-sectional view of a prior art down-hole pumping apparatus to which the present invention can be attached.
Figure 2:
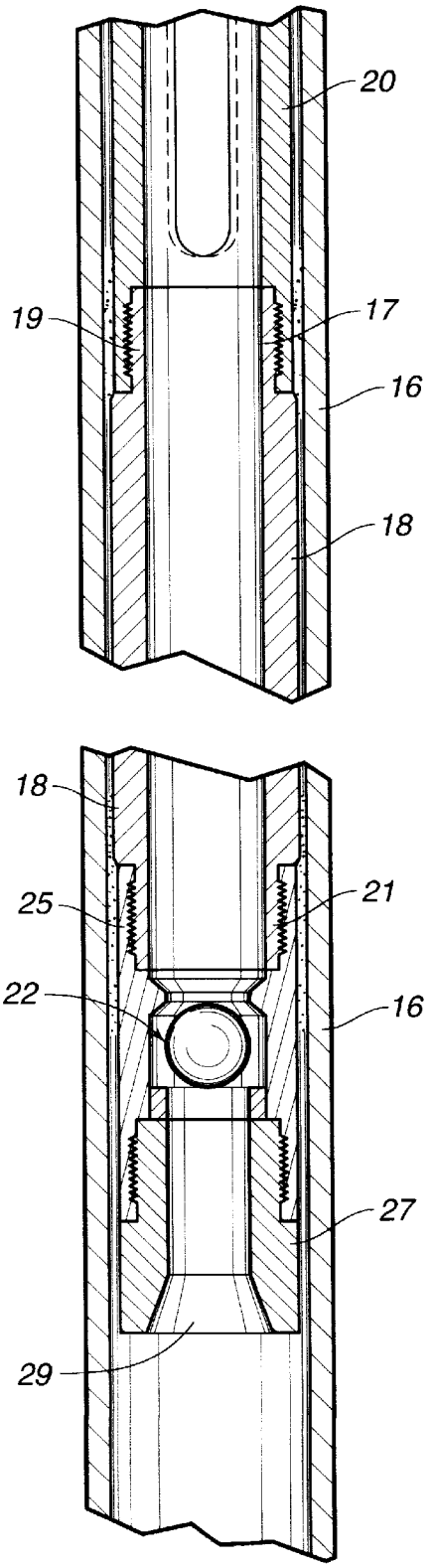
FIG. 2 Prior Art
FIG. 2 is a detailed cross-sectional view of the plunger apparatus of the downhole pump apparatus of the prior art.
Figure 3:
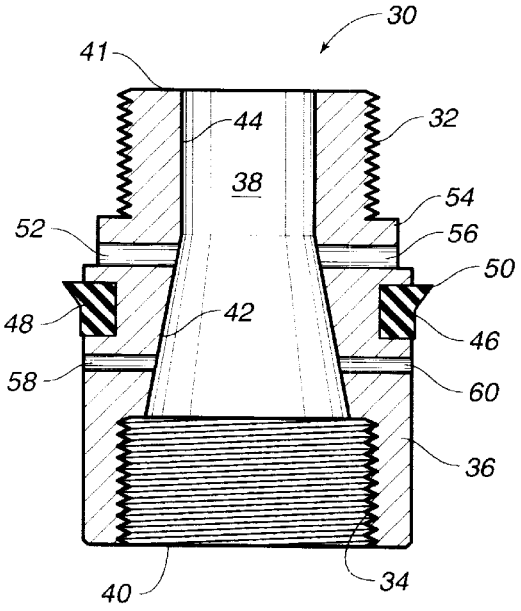
FIG. 3 is a cross-sectional view of the wiping device used in the upper part of the plunger of the pump.

Referring to FIG. 3, there is shown at 30 the upper sand wiping device as used on the plunger 18 of FIG. 1. Sand wiping device 30 includes an upper externally threaded area 32 and a lower internally threaded area 34 formed on body 36. An interior passageway 38 will extend from the bottom 40 to the top 41 of the wiping device 30. The internal passageway will open, at one end, to the internally threaded area 34. A frustoconical interior area 42 will extend from the threaded area 34 to a tubular section 44. This constant tapering, as found in the frustoconical section 42, avoids stress risers within the interior of the body 36.

As can be seen in FIG. 3, a groove 46 is formed circumferentially around the body 36. An annular wiping member 48 is received within the groove 46. Annular wiping member 48 is formed of urethane material and includes an outer edge 50 suitable for moving in close proximity to the interior surface of the working barrel 16 of the pumping apparatus 10. A first pair of radial ports 52 and 54 extend through the body 36 from the interior passageway 38. As such, during normal pumping action, a portion of the oil will flow outwardly of the ports 52 and 54 so as to effectively flush sand accumulation from around the shoulder 56 of body 36. So as to avoid unequal pressures, ports 58 and 60 extend radially from the interior passageway 38 on another side of the wiping member 48 from the ports 52 and 54.

Figure 4:
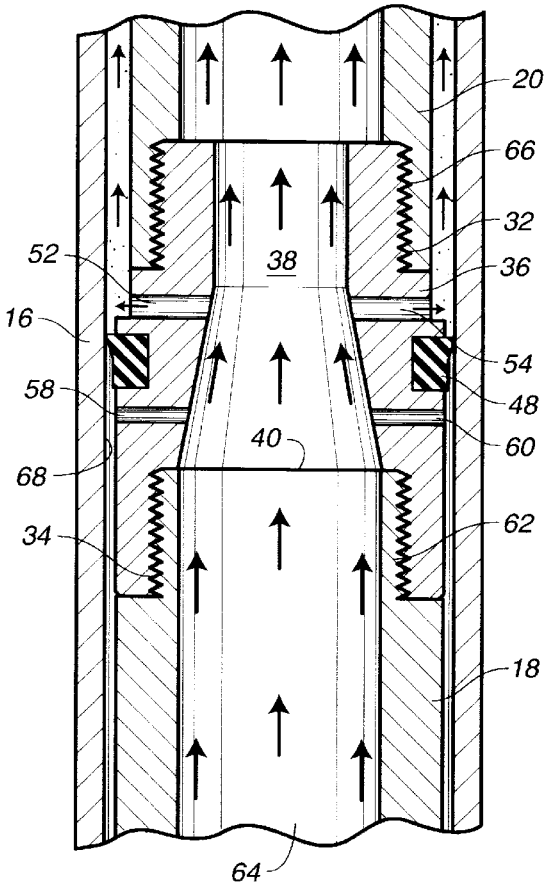
FIG. 4 is a cross-sectional view showing the attachment of the device to the plunger and to the plunger cage.

FIG. 4 shows how the body 36 can be connected to the plunger cage 20 and to the plunger 18. It can be seen that the plunger 18 has an externally threaded section 62 formed at a top end of the plunger 18. The internally threaded area 34 of body 36 will threadedly receive the externally threaded area 62 of the plunger 18. An interior passageway 64 of the plunger 18 will be aligned with the opening 40 at the bottom of the body 36.

Similarly, the plunger cage 20 has an internally threaded area 66 which is threadedly received about the externally threaded area 32 of the body 36. The wiping member 48 is shown as having its edge extending in close proximity to the inner diameter 68 of the working barrel 16. Within the concept of the present invention, it is possible to form the upper sand wiping device 30 directly on the plunger cage 20.

As can be seen in FIG. 4, when the plunger 18 moves downwardly, oil and suspended sand will pass upwardly through the interior passageway 38 of the body 36. The ports 52 and 54 allow a small portion of the oil flow to pass outwardly therethrough into the area between the exterior of the plunger cage 20 and the interior wall 68 of the working barrel 16. This flow of oil will tend to "flush" any sand from the area between the wiping member 48 and the exterior surface of body 36. Ports 58 and 60 extend radially from the interior passageway 38 so as to cause pressure equalization with the ports 52 and 54. The wiping action caused by the wiping member 48 will prevent any sand from accumulating along the interior surface 68 of the working barrel 16. As such, the wiping member 48 effectively prevents sand from accumulating in and amongst the seals associated with the plunger 18.

Figure 5:
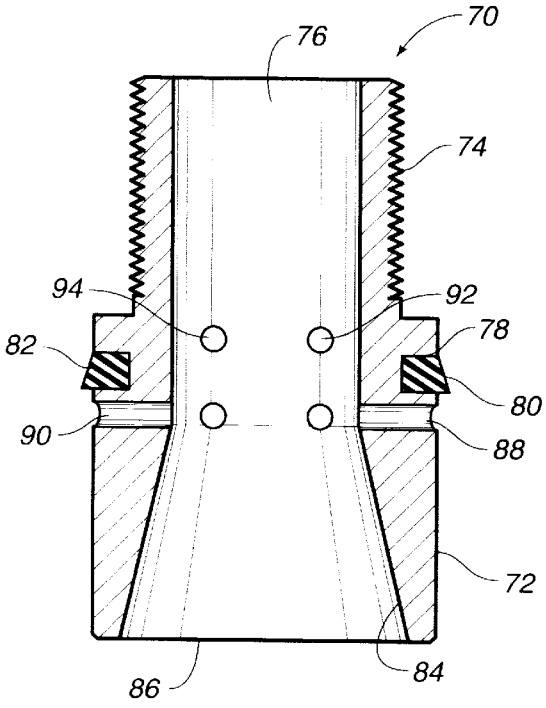
FIG. 5 is a cross-sectional view showing the wiping device as attached to the lower end of the plunger.

FIG. 5 shows the second device 70 which is suitable for attachment adjacent to the one way valve 22 at the bottom of the plunger 18. The device 70 includes a body 72 having an upper externally threaded area 74 with an interior passageway 76 extending therethrough. A circumferential groove 78 is formed centrally around the body 72. The annular wiping member 80 is received within the circumferential groove 78. The wiping member 80 includes an edge 82 suitable for contact along the inner wall 68 of the working barrel 16. The interior passageway 78 includes a venturi area 84 opening at the bottom 86 of body 72. The venturi area 84 tapers so as to have a wide diameter at the bottom 86 of body 72 and a narrow diameter adjacent the wiping member 80. The venturi area 84 communicates with radial ports 88 and 90. Pressure equalization ports 92 and 94 open to the internal passageway 76 so as to equalize fluid pressure on each side of the wiping member 80.

Figure 6:
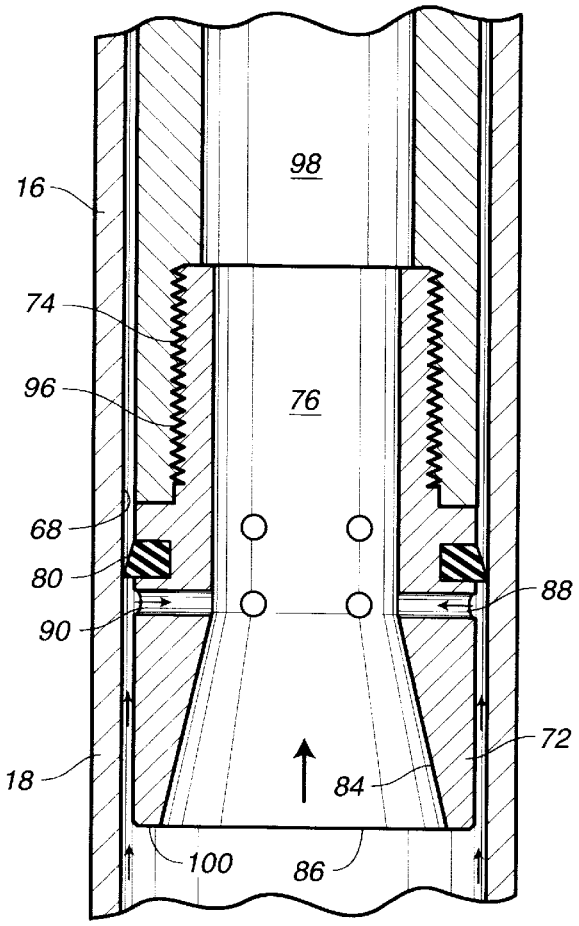
FIG. 6 is a cross-sectional view showing the device as attached to the lower end of the plunger in the oil pump of the present invention.

In FIG. 6, it can be seen that the externally threaded area 74 is connected to an internally threaded portion 96 of the plunger 18. The internal passageway 76 will communicate with an interior passageway 98 of the plunger 18. In normal use, when the plunger 18 moves downwardly, oil with suspended sand will pass into the opening 86 at the bottom 100 of the body 72. The arrows in FIG. 6 illustrate the direction of fluid flow. Since the interior passageway 76 includes a venturi portion 84, the flow of fluid through the interior passageway 76 will draw a certain amount of fluid through the ports 88 and 90. When the fluid is drawn through the ports 88 and 90, the fluid will flush any residual sand remaining along the inner wall 68 of the working barrel 16. The wiping action caused by the wiping member 80 will further serve to remove any accumulation of sand along the inner wall 68. The flushing action caused by the flow of fluid through the ports 88 and 90 into the interior passageway 76 will cause the oil and suspended sand to move upwardly through the interior passageway 76 and into the opening 98 of the plunger 18.

Figure 7:
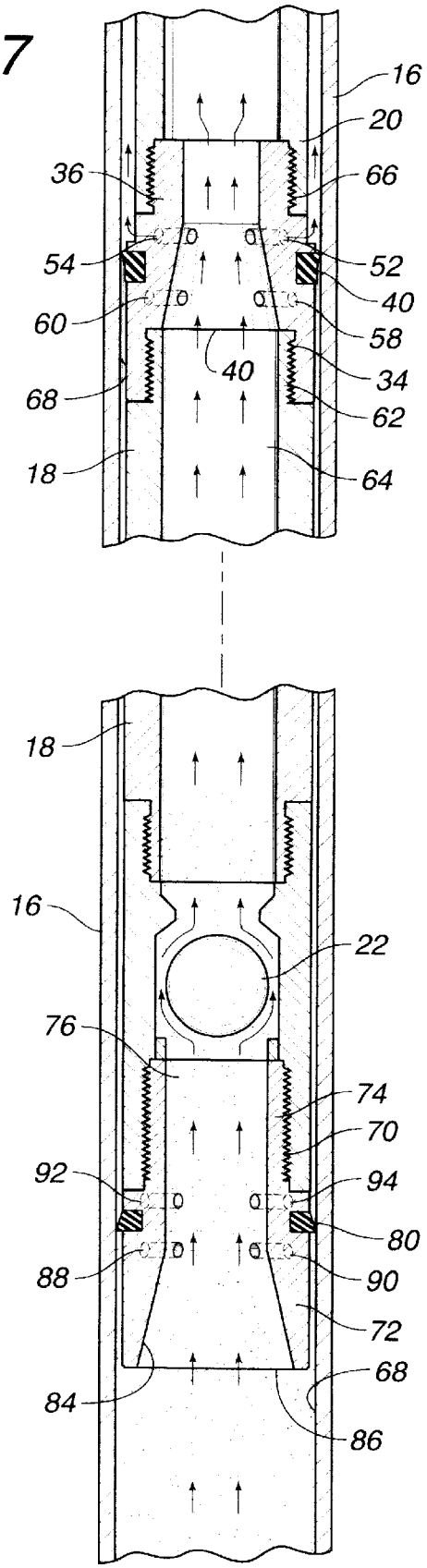
FIG. 7 is a detailed cross-sectional view of the completely assembled apparatus of the present invention.

In FIG. 7, it is shown that the present invention is a device for attaching to the top and the bottom of a plunger 18 a sub-surface pump. The urethane wiper member is used on the device so that no sand can get between the plunger 18 and the working barrel 16. The accumulation of sand in the area between the plunger 18 and the working barrel 16 is a major cause of pump failure. The present invention places ports on both sides of the wiping member so as to allow pressure to be equalized on both sides. As such, no fluid pressure is placed upon the wiping member. The cone-shaped restriction forces flow through the top port and carries accumulated sand to the surface of the well.

One of the devices 36 of the present invention attaches to the top of the plunger 18. The other device 70 replaces the seat plug 27 on the bottom of the plunger 18. On each down stroke, accumulated sand is flushed from the wiper by the port arrangement. This serves to extend the life of the plunger and the working barrel. The present invention prevents sand cut plungers and barrels. The durable stainless steel construction of the bodies of each of the devices of the present invention provides for long lasting operation. The device works with tubing pumps and with traveling barrel pumps. The wiper serves to prevent sand from seizing the plunger and also prevents stuck plungers. Pump life and efficiency are extended by the devices of the present invention. Furthermore, the present invention prevents iron oxide build-up.

The foregoing disclosure and description of the invention is illustrative and explanatory thereof, and various changes in the method steps, as well as in the details of the illustrated apparatus, may be made within the scope of the appended claims, without departing from the true spirit of the invention. The present invention should be limited by the following claims and their legal equivalents.

I claim:

1. An oil pumping apparatus comprising:

a downhole tubing;

a valve rod positioned within the downhole tubing and adapted for reciprocating movement within the downhole tubing;

a working barrel positioned within the downhole tubing, said valve rod received within said working barrel, said working barrel having a one-way valve at one end thereof;

a plunger positioned within said working barrel and interconnected to said valve rod so as to move in correspondence with the reciprocating movement of said valve rod, said plunger having a one-way valve at an end opposite said valve rod;

a first sand remover attached between said valve rod and said plunger, said first sand remover having a wiper extending outwardly therefrom so as to be in wiping contact with an interior surface of said working barrel; and a second sand remover attached to a bottom of said plunger below said one-way valve of said plunger, said second sand remover having a wiping member extending outwardly therefrom so as to be in wiping contact with the interior surface of said working barrel.

2. The apparatus of claim 1, said valve rod having a plunger cage at one end, said first sand remover having one end threadedly attached to said plunger cage, said first sand remover having an opposite end threadedly affixed to an end of said plunger.

3. The apparatus of claim 2, said wiper of said first sand remover being positioned between said plunger cage and said plunger.

4. The apparatus of claim 2, said first sand remover comprising:

a body having an interior passageway extending longitudinally therethrough of a size suitable for allowing oil to flow therethrough, said body having a first threaded end attached to said plunger cage and a second threaded end attached to said plunger, said body having a circumferential groove extending therearound between said first threaded end and said second threaded end, said wiper being positioned within said circumferential groove.

5. The apparatus of claim 4, said interior passageway having a frustoconical section having a wide end opening at a bottom of said body at said second threaded end, said interior passageway having a straight tubular section extending from a top of said frustoconical section to a top of said body at said first threaded end.

6. The apparatus of claim 4, said first threaded end being an externally threaded area, said second threaded end being an internally threaded area.

7. The apparatus of claim 4, said wiper being an annular member having an edge extending outwardly of said circumferential groove, said edge being in wiping contact with said working barrel.

8. The apparatus of claim 4, said body having a plurality of pressure equalization ports extending radially through said body from said interior passageway.

9. The apparatus of claim 8, said plurality of pressure equalization ports comprising:

a first pair of pressure equalization ports extending radially through said body from said interior passageway, said first pair of pressure equalization ports opening on an exterior of said body on one side of said wiper; and a second pair of pressure equalization ports extending radially through said body from said interior passageway, said second pair of pressure equalization ports opening on the exterior of said body on an opposite side of said wiper.

10. The apparatus of claim 1, said second sand remover comprising:

a body having an interior passageway extending longitudinally therethrough of a size suitable for allowing oil to flow therethrough, said body having a first threaded end attached to said bottom of said plunger, said body having a groove formed circumferentially therearound, said wiping member being received within said circumferential groove.

11. The apparatus of claim 10, said wiping member being an annular member having an edge extending outwardly of said circumferential groove, said edge being in wiping contact with said working barrel.

12. The apparatus of claim 10, said interior passageway having a venturi section having a wide end opening at a bottom of said body, said venturi section having a radial passageway extending therefrom through said body and opening to an exterior of said body on a side of said wiping member opposite said first threaded end.

13. The apparatus of claim 10, further comprising:

a first pair of pressure equalization ports extending radially through said body from said interior passageway, said first pair of pressure equalization ports opening on an exterior of said body on one side of said wiping member.

14. A sand removal apparatus comprising:

a working barrel;

a plunger positioned within said working barrel;

a valve rod; and a body having an interior passageway extending longitudinally therethrough of a size suitable for allowing oil to flow therethrough, said body having a first end attached to said valve rod and a second end attached to said plunger, said body having a wiper affixed circumferentially therearound, said wiper having a surface extending outwardly of said body in wiping contact with an interior surface of said working barrel, said interior passageway having a frustoconical section having a wide end opening at a bottom of said body at said second end, said interior passageway having a straight tubular section extending from a top of said frustoconical section to a top of said body at said first end.

15. The apparatus of claim 14, said first end being externally threaded and adapted for attachment to attached to a plunger cage at an end of the said valve rod, said second end being internally threaded.

16. The apparatus of claim 14, said body having a circumferential groove extending therearound between said first and second ends, said wiper being an annular member received by said circumferential groove, said surface of said wiper being an edge extending outwardly of said circumferential groove.

17. A sand removal apparatus comprising:

a working barrel;

a plunger positioned within said working barrel;

a valve rod;

a body having an interior passageway extending longitudinally therethrough of a size suitable for allowing oil to flow therethrough, said body having a first end attached to said valve rod and a second end attached to said plunger, said body having a wiper affixed circumferentially therearound, said wiper having a surface extending outwardly of said body in wiping contact with an interior surface of said working barrel;

a first pair of pressure equalization ports extending radially through said body from said interior passageway, said first pair of pressure equalization ports opening on an exterior of said body on one side of said wiper; and a second pair of pressure equalization ports extending radially through said body from said interior passageway, said second pair of pressure equalization ports opening on the exterior of said body on an opposite side of said wiper.

18. A sand removal apparatus comprising:

a working barrel;

a plunger positioned within said working barrel;

a body having an interior passageway extending longitudinally therethrough of a size suitable for allowing oil to flow therethrough, said body having a first end attached to a bottom of said plunger, said body having a groove formed circumferentially therearound; and a wiping member received within said circumferential groove, said wiping member being an annular member having an edge extending outwardly of said circumferential groove, said edge in wiping contact with an interior surface of said working barrel.

19. The device of claim 18, said interior passageway having a venturi section having a wide end opening at a bottom of said body, said venturi section having a radial passageway extending therefrom through said body and opening to an exterior of said body on a side of said wiping member opposite said first end.

20. The device of claim 18, further comprising:

a first pair of pressure equalization ports extending radially through said body from said interior passageway, said first pair of pressure equalization ports opening to an exterior of said body on one side of said wiping member.

* * * * *